US009117425B1

(12) United States Patent
Hightower

(10) Patent No.: US 9,117,425 B1
(45) Date of Patent: Aug. 25, 2015

(54) PORTABLE STAND FOR MUSIC INSTRUMENTS AND METHOD OF USING SAME

(71) Applicant: Arthur J. Hightower, Peekskill, NY (US)

(72) Inventor: Arthur J. Hightower, Peekskill, NY (US)

( * ) Notice: Subject to any disclaimer, the term of this patent is extended or adjusted under 35 U.S.C. 154(b) by 0 days.

(21) Appl. No.: 14/217,136

(22) Filed: Mar. 17, 2014

Related U.S. Application Data

(60) Provisional application No. 61/794,097, filed on Mar. 15, 2013.

(51) Int. Cl.
*G10D 13/02* (2006.01)

(52) U.S. Cl.
CPC ..... *G10D 13/026* (2013.01)

(58) Field of Classification Search
CPC ..... G10D 13/026
See application file for complete search history.

(56) References Cited

U.S. PATENT DOCUMENTS

| | | | | |
|---|---|---|---|---|
| 4,215,838 | A | 8/1980 | Gullota | 248/121 |
| D296,447 | S | 6/1988 | Jowitt | D17/22 |
| D303,331 | S | 9/1989 | Diaz | D6/491 |
| 5,329,838 | A | 7/1994 | Yamashita | 84/421 |
| 5,335,575 | A * | 8/1994 | Hoshino | 84/421 |
| 5,467,680 | A | 11/1995 | Kurosaki | 84/421 |
| 5,739,449 | A | 4/1998 | Torres, Jr. | 84/421 |
| 5,973,244 | A | 10/1999 | McCulloch | 84/327 |
| 6,040,514 | A * | 3/2000 | Liao | 84/421 |
| 6,121,527 | A | 9/2000 | Hamm | 84/327 |
| 6,215,054 | B1 | 4/2001 | Woodhouse et al. | 84/421 |
| D462,711 | S | 9/2002 | Arsala | D17/22 |
| D482,904 | S | 12/2003 | Slaymaker | D6/466 |
| 6,722,617 | B2 | 4/2004 | Wilfer | 248/163.1 |
| 6,723,907 | B2 | 4/2004 | Sato | 84/421 |
| 6,835,883 | B2 | 12/2004 | Stevens | 84/453 |
| 7,131,615 | B1 | 11/2006 | Bruce | 248/127 |
| 7,294,775 | B1 | 11/2007 | Spoljaric, Jr. | 84/421 |
| 7,365,257 | B2 | 4/2008 | Sato | 84/421 |
| 7,514,616 | B2 | 4/2009 | Sawhney | 84/327 |
| 7,572,967 | B2 * | 8/2009 | Meinl | 84/421 |
| 7,718,878 | B2 | 5/2010 | May | 84/422.1 |
| 7,777,110 | B2 | 8/2010 | Wallis | 84/327 |
| 7,807,910 | B1 | 10/2010 | Berardo | 84/411 R |
| D628,830 | S | 12/2010 | Mono | D6/466 |
| 7,893,332 | B1 | 2/2011 | Lundberg | 84/327 |
| 7,900,881 | B2 | 3/2011 | Campagna | 248/153 |
| 8,016,253 | B1 | 9/2011 | Yu | 248/161 |
| 8,766,074 | B1 * | 7/2014 | Flores | 84/421 |
| 2004/0051021 | A1 * | 3/2004 | Micheel | 248/346.01 |

* cited by examiner

*Primary Examiner* — Robert W Horn
(74) *Attorney, Agent, or Firm* — Pollack, P.C.

(57) ABSTRACT

An article for supporting a music instrument such as a conga drum is disclosed. The article is shaped for engagement with a lower rim of the drum and suspending the same at a relatively low height and first selected angle for optimal comfort, efficiency and drum performance, the article shape also being such that, upon positioning the article in an alternative position, and engagement with the lower rim, the drum is suspended at a relatively greater height and second selected angle for optimal comfort, efficiency and drum performance.

6 Claims, 7 Drawing Sheets

PORTABLE STAND FOR MUSIC INSTRUMENTS AND METHOD OF USING SAME

This Application is based on and claims the benefit of U.S. Provisional Patent Application Ser. No. 61/794,097, filed on Mar. 15, 2013, the disclosure of which is hereby incorporated by reference herein in its entirety.

FIELD OF THE DISCLOSURE

This disclosure relates generally to support structures and, more particularly, to arrangements for mounting music instruments and the like.

BACKGROUND OF THE DISCLOSURE

Conventional support structures for music instruments, such as conga drums, endeavor to support an instrument in an upright position for play mostly from a standing position, whether during practice or a musical performance. Some support stands, intended primarily for conga drums, utilize an assembly of one or more collapsible legs mounted to the drum, e.g., four to six legs of varying height, to approximate a truncated cone for receiving the drum lower end and, thereby, suspend and support the drum in a vertical position, while providing collapsibility for storage after use.

Others utilize a support ring suspended by legs, each leg having a holding attachment for engaging the sides of the drum. Still other support stands provide a ring-framed carrier with a round hole at its center and balancing blocks extending from its rim and being adjustable radially thereto for securing a lower rim of the conga drum.

Further drum stands utilize one or more support legs attached permanently to the drum. While such arrangements have been found useful for base drums, their geometry, the permanence of the support leg mounting, and need to drill holes in the drum and/or use mounting brackets can not only interfere with the use and acoustics of the drums, but also limit the angle, direction and length of adjustment. In addition, maintaining one angle and/or one height, which is standard for most players, is considered unsuitable for optimal conga drum operation, collapsibility and portability. Moreover, the permanence of the support legs adds weight and bulk and hinders portability of the drums.

Adjustable stands have also been developed for small percussion devices (e.g., cymbals and traps). Such stands utilize, for instance, an adjustable shaft, rail and setscrew or tool arrangement to lock the shaft against rotation and, thereby, prevent undesired movement of the device, which is connected to the shaft. While beneficial for relatively small percussion devices, they are deemed unsuitable for congas and other large percussion arrangements. In addition, they are permanently mounted to, and provide support from, the top of the drum, as opposed to support from beneath the drum which enables sound to project from there below. Furthermore, special tools that may be required for their set-up or take-down are often expensive and easy to lose.

In the case of conga drums, a support stand is, therefore, desired that not only provides structural stability and prevents damage to the drum from tipping, falling and striking a hard surface during use, but also orients the drum suitably for optimum play, particularly from a seated position, without hindrance of percussive and other acoustic sounds produced. Also significant is the need for rapid deployment of the structures for a music performance and take-down when a show is over and the musician wishes to leave the stage relatively quickly to make room for the next performer or to travel elsewhere for the next gig.

A simple, low cost, light weight, effective and non-obtrusive support for conga drums, especially from a seated position, is, therefore, desired that provides ease and simplicity in their set-up, take-down and portability for transport.

OBJECTS AND SUMMARY OF THE DISCLOSURE

Accordingly, it is an object of this disclosure to provide a support structure for a conga drum that not only elevates the drum from the floor during use, but is also light weight, easily portable and readily collapsible.

Another object of the disclosure is to provide a support structure for a conga drum that stabilizes the drum relative to the floor while facilitating fuller and richer sound emanating from the drum.

A further object of the disclosure is to provide a support structure for a conga drum that permits the user to position the angle of the drum such that the top end of the drum is tilted toward the user and the bottom front of the drum opening is higher than the rear so as to project sound waves produced by the drum toward the floor such that the waves bounce off of the floor and emanate in a direction forward of the drum.

Still another object of the disclosure is to provide a support structure for a conga drum that allows the drum to be readily removed from the stand without requiring the use of both hands, a special tool that is expensive and easy to lose, or a release mechanism.

Yet another object of the disclosure is to provide a support structure for a conga drum that protects the drum against damage from contacting surfaces.

Another object of the disclosure is to provide a support structure for a conga drum that is readily collapsible into an easily transported configuration.

A further object of the disclosure is to provide a support structure for a conga drum that is universal, unobtrusive, simple easy to use and set-up, compact and lightweight.

Still another object of the disclosure is to provide a support structure for a conga drum that is well-balanced, portable, strong and easily adaptable for positioning the drum at varying heights.

Yet another object of the disclosure is to provide a support structure for a conga drum that accommodates a broad range of size of performers who play the drum in a seated position with the drum angled toward him/her.

Still a further object of the disclosure is to provide a simple array of support solutions for a conga drum that operate in tandem, or separately, to balance and support as many drums as a performer desires.

Yet a further object of the disclosure is to provide a method of supporting a conga drum that is suitable for playing any sized conga drum and in a preferred position, whether standing, seated or otherwise.

Another object of the disclosure is to provide a conga drum stand that is easy to carry but without the inconvenience of requiring a special housing or extra cases.

An additional object of the disclosure is to provide a conga drum stand that supports the fierce pounding and strikes of master and novice drummers applying rhythms to the drum heads, without interfering with the tone of the drum or the timbre of the rhythm.

Still another object of the disclosure is to provide a conga drum stand that is rock solid and does not make any noise or sounds that would interfere with the tone or rhythm being created.

A further object of the disclosure is to provide a conga drum stand that is not only constructed of materials that meet the standards of extreme handling and very aggressive pressures, but also has no moving parts.

Yet another object of the disclosure is to provide a customizable, user selected arrangement for supporting a conga drum, depending on user preference and/or experience level.

A further object of the disclosure is to accommodate and provide a support system for those who play conga-like drums from a seated position.

In accordance with one aspect of the disclosure, a plurality of multiple-geometry articles for supporting a conga drum is provided, each article having a selected number of faces, each face serving a different support function and/or providing different points of contact depending upon the support and positioning desired of the conga drum and orientation of the structure needed to accomplish same. Each article comprises a rectangular, vertically disposed block-like body section with a step-like rectangular block extension formed with and extending from a bottom portion of one side face of the body, the rectangular extension having a truncated trapezoidal block extension formed with and extending from a laterally extending face of the rectangular extension, the face of the trapezoidal extension truncated side being in alignment and coextensive with the laterally extending face and the sloping side of the trapezoidal extension facing outwardly therefrom, the rectangular body section and the step-like rectangular block extension defining, at an upper point of intersection, a first rabbet-like or notch joint for receiving a selected lower edge of a conga drum, and defining, at a lower point of intersection, a second rabbet-like or notch joint for receiving a rectangular, horizontally disposed block-like body, the width of the vertically disposed body being substantially less than the length of the horizontally disposed body such that, upon engagement of the horizontally disposed body with the second rabbet-like or notch joint of the vertically disposed body, one or more portions of the horizontally disposed body protrude laterally from vertical sides of the vertically disposed body.

According to another aspect of the disclosure, each article comprises a first elongated housing, disposed in a first direction, the housing having major and minor portions, a stepwise portion being formed with and extending from the minor portion from one side of the body, the stepwise portion having an elongated portion formed with and extending radially from the stepwise extension, the elongated portion side generally being in alignment and coextensive with the stepwise extension and having a sloping surface in proximity to an outward end thereof, the elongated housing and the stepwise portion defining a first rabbet-like or notch joint region for receiving a selected lower edge of a conga drum, and defining a second rabbet-like or notch joint region, a second elongated housing being formed with and extending generally laterally from the second rabbet-like or notch joint region, the width of the first elongated housing being substantially less than the length of the second elongated housing such that one or more portions of the second elongated body protrude laterally. Alternatively or concurrently, the respective housings, portions and extensions are formed as a single unit with the aforementioned configuration.

In accordance with a further aspect of the disclosure, there is provided a method of supporting a conga drum which comprises the steps of (i) forming a plurality of multi-geometry articles, each of which comprises a rectangular, vertically disposed block-like body section with a step-like rectangular block extension formed with and extending from a bottom portion of one side face of the body, the rectangular extension having a truncated trapezoidal block extension formed with and extending from a laterally extending face of the rectangular extension, the face of the trapezoidal extension truncated side being in alignment and coextensive with the laterally extending face and the sloping side of the trapezoidal extension facing outwardly therefrom, the rectangular body section and the step-like rectangular block extension defining, at an upper point of intersection, a first rabbet-like or notch joint for receiving a selected lower edge of a conga drum, and defining, at a lower point of intersection, a second rabbet-like or notch joint for receiving a rectangular, horizontally disposed block-like body, the width of the vertically disposed body being substantially less than the length of the horizontally disposed body such that, upon engagement of the horizontally disposed body with the rabbet-like or notch joint of the vertically disposed body, one or more portions of the horizontally disposed body protrude laterally from vertical sides of the vertically disposed body; and (ii) arranging each of the articles radially, in a selected plane and in a first orientation relative to and corresponding with a bottom edge of a selected conga drum such that the second rabbet-like or notch joint of each article engages the bottom edge portion of the drum, and the respective bottom faces of the horizontally disposed body and of the trapezoidal extension are in engagement with and generally flat against the floor.

In accordance with still another aspect of the disclosure, there is provided a method of supporting a conga drum which comprises the steps of: (i) forming a plurality of multi-geometry articles, each of which comprises a first elongated housing, disposed in a first direction, the housing having major and minor portions, a stepwise portion being formed with and extending from the minor portion from one side of the body, the stepwise portion having an elongated portion formed with and extending radially from the stepwise extension, the elongated portion side generally being in alignment and coextensive with the stepwise extension and having a sloping surface in proximity to an outward end thereof, the elongated housing and the stepwise portion defining a first rabbet-like or notch joint region for receiving a selected lower edge of a conga drum, and defining a second rabbet-like or notch joint region, a second elongated housing being formed with and extending generally laterally from the second rabbet-like or notch joint region, the width of the first elongated housing being substantially less than the length of the second elongated housing such that one or more portions of the second elongated body protrude laterally; and (ii) arranging each of the articles radially, in a selected plane and in a first orientation relative to and corresponding with a bottom edge of a selected conga drum such that the second rabbet-like or notch joint of each article engages the bottom edge portion of the drum, and the respective bottom faces of the horizontally disposed body and of the trapezoidal extension are in engagement with and generally flat against the floor. Alternatively or concurrently, the respective housings, portions and extensions are formed as a single unit with the aforementioned configuration.

In accordance with yet another aspect of the disclosure, the article is shaped for engagement with a lower rim of the drum and suspending the same at a relatively low height and first selected angle for optimal comfort, efficiency and drum performance, the article shape also being such that, upon positioning the article in an alternative position, and engagement with the lower rim, the drum is suspended at a relatively greater height and second selected angle for optimal comfort, efficiency and drum performance.

BRIEF DESCRIPTION OF THE DRAWINGS

The same numerals are used throughout the figure drawings to designate similar elements. Still other objects and advantages of the music stand will become apparent from the following description.

DETAILED DESCRIPTION

Drums such as conga drums comprise relatively tall cylindrical hive-like structures open at the top and bottom ends with a drum skin covering the top opening. The drum is usually positioned with the bottom opening either tilted on one bottom edge or suspended a selected distance from the floor. Positioning of the bottom opening flat against the floor notably impedes the drum sound from emanating when a user strikes the drum skin producing sound within the cylindrical drum. Generally speaking, these drums are unique among percussion instruments in that they are large, tall and cylindrical in design, often weighing in excess of 70 pounds, and must be tilted or suspended at least a narrow distance from the floor, e.g., between about ¼" and about 1", for effective operation. Hence, a suitable conga drum stand must provide elevation and orientation of the drum so as to allow the player to achieve a "full" rich sound. The stand must also be relatively light weight and easily portable.

The foregoing discussion is provided for purposes of illustration and is not intended to limit the environment of the portable stand and method disclosed herein. The remaining structural and functional aspects of conga drums are known by those skilled in the art and further description is considered unnecessary for illustration of this disclosure.

Figure 7:
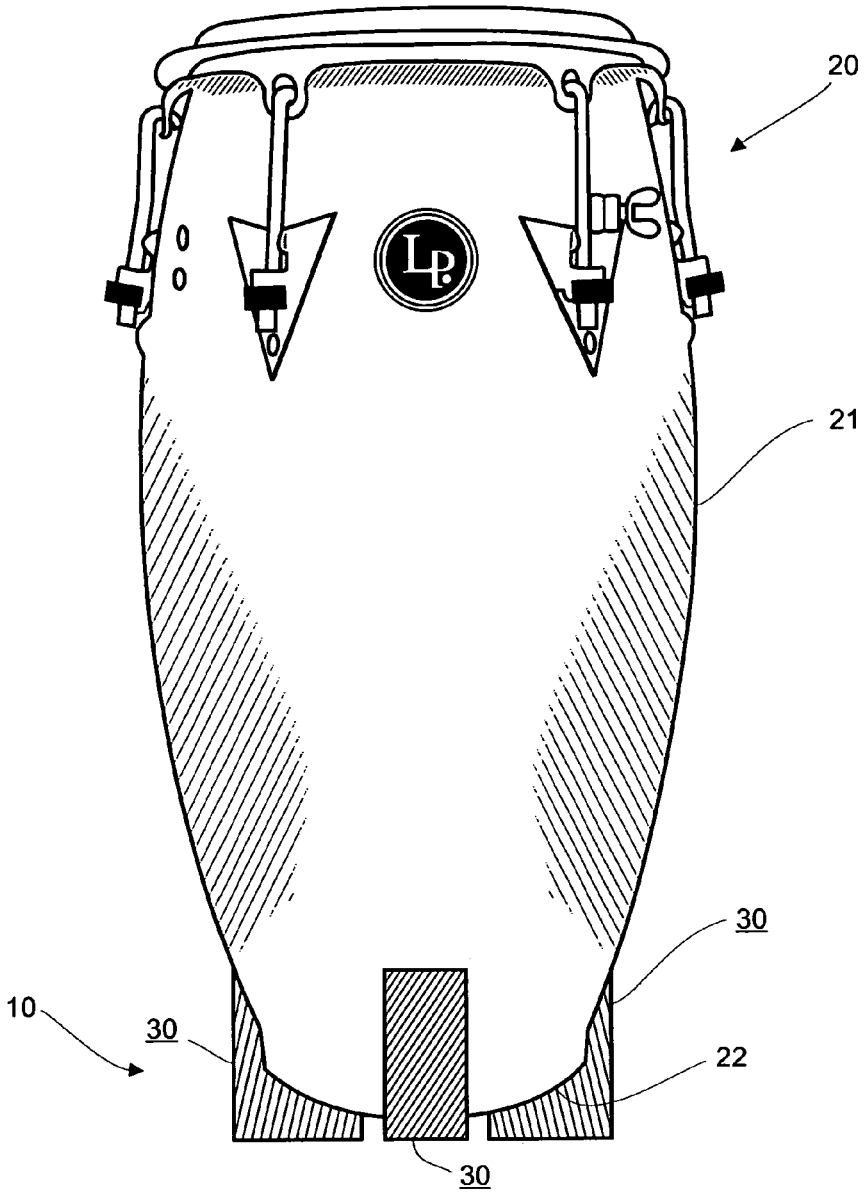
FIG. 7 is a perspective view of a plurality of multi-geometry articles of FIG. 1 supporting a conga drum in a first position.
Figure 8:
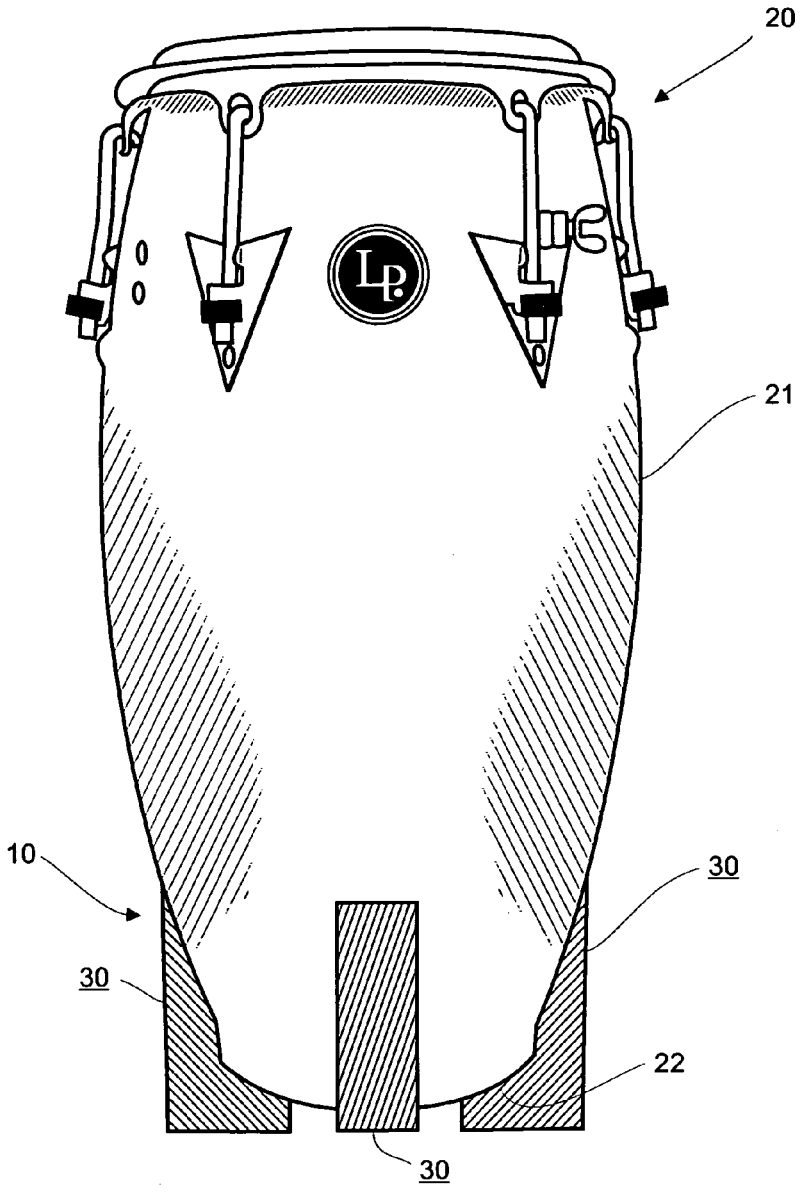
FIG. 8 is a perspective view of a plurality of multi-geometry articles of FIG. 1 supporting a conga drum in a second position.
Figure 9:
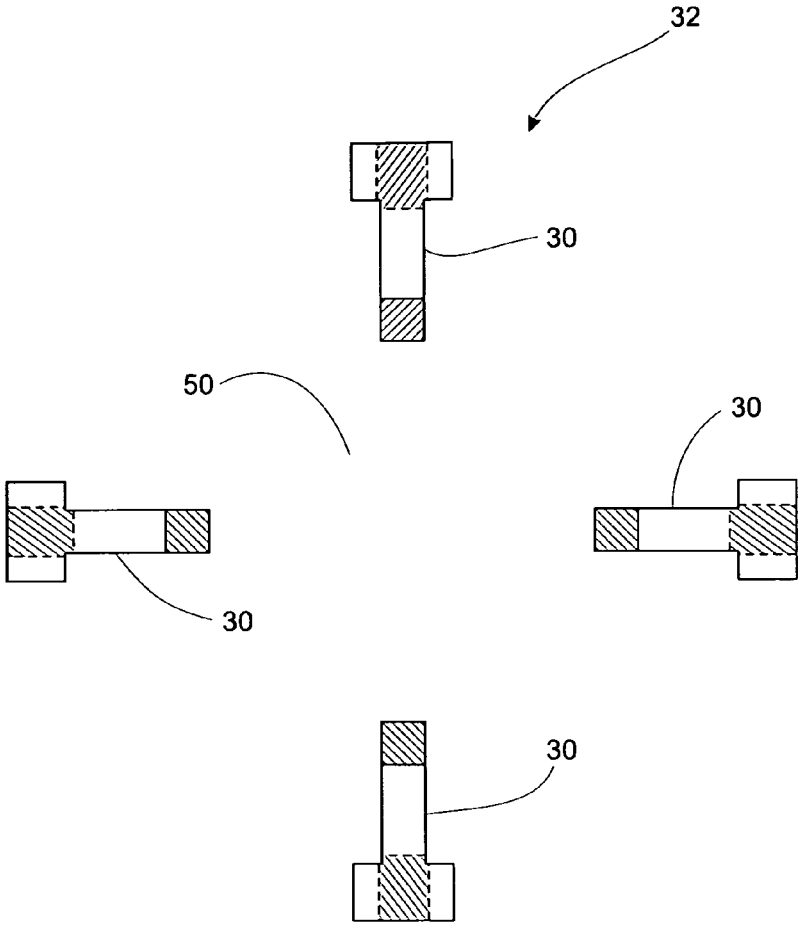
FIG. 9 is a plan view of an array of the articles illustrated in FIG. 7.

Referring now to the drawings and, more particularly, to FIGS. 1-9, there is shown generally a specific, illustrative portable stand 10 for a music instrument 20 and method of using the same, according to various aspect of the disclosure. In one embodiment, set forth in FIGS. 1-3, the stand comprises a plurality of versatile, multiple-geometry articles or block structures 30, each having a selected number of faces 31, e.g., 12, and each face serving a different support function and/or providing different points of contact depending upon the support and positioning desired of the conga drum and orientation of the structure needed to accomplish same. As shown in FIG. 9, the articles are preferably arranged in a selected array 32 about a support surface 50, e.g., a floor or ground surface, for mounting a drum 21, such as a conga or conga-like drum, illustrated in FIGS. 7 and 8, each article being configured for engagement with a selected lower edge 22, preferably a bottom rim portion of the conga drum, and suspending the drum at a selected height and angle for optimal comfort, efficiency and drum performance.

Specifically, each block structure comprises, for instance, a rectangular, vertically disposed block-like body 33 with a step-like rectangular block extension 34, e.g., approximately 3.5 inches long, formed with and extending from a bottom portion 35 of one side face 36 of the body, the vertically disposed body having selected dimensions, for instance, about 2.25 inches long, about 1.5 inches wide and about 2.75 inches high. The rectangular extension includes a truncated trapezoidal block extension 37, for example, approximately 4.75 inches long on the long side and around 3.5 inches on the short side, formed with and extending from a laterally extending face 38 of the rectangular extension, the face 39 of the trapezoidal extension truncated side 40 being in alignment and coextensive with laterally extending face 41 and sloping side 42, respectively, of the trapezoidal extension facing outwardly therefrom, the slope of the side 42 suitably being, for example, about 45 degrees.

In this connection, the vertically disposed body and the step-like rectangular block extension define, at an upper point of intersection 43, a first rabbet-like or notch joint 44 for receiving lower edge 22 of the conga drum, and define, at a lower point of intersection 45, a second rabbet-like or notch joint 46 for receiving a rectangular, horizontally disposed block-like body 47, the width 33*a*, e.g., about 1.5 inches, of the vertically disposed body being substantially less than the length 47*a*, e.g., approximately 3.5 inches, of the horizontally disposed body such that, upon engagement of the horizontally disposed body with the second rabbet-like or notch joint of the vertically disposed body, one or more portions 48 of the horizontally disposed body protrude laterally from vertical sides of the vertically disposed body, e.g., a distance of about 1 inch from each vertical side. According to one arrangement, the horizontally disposed body has a width of about 2 inches and a depth of approximately 0.75 inch.

Figure 1:
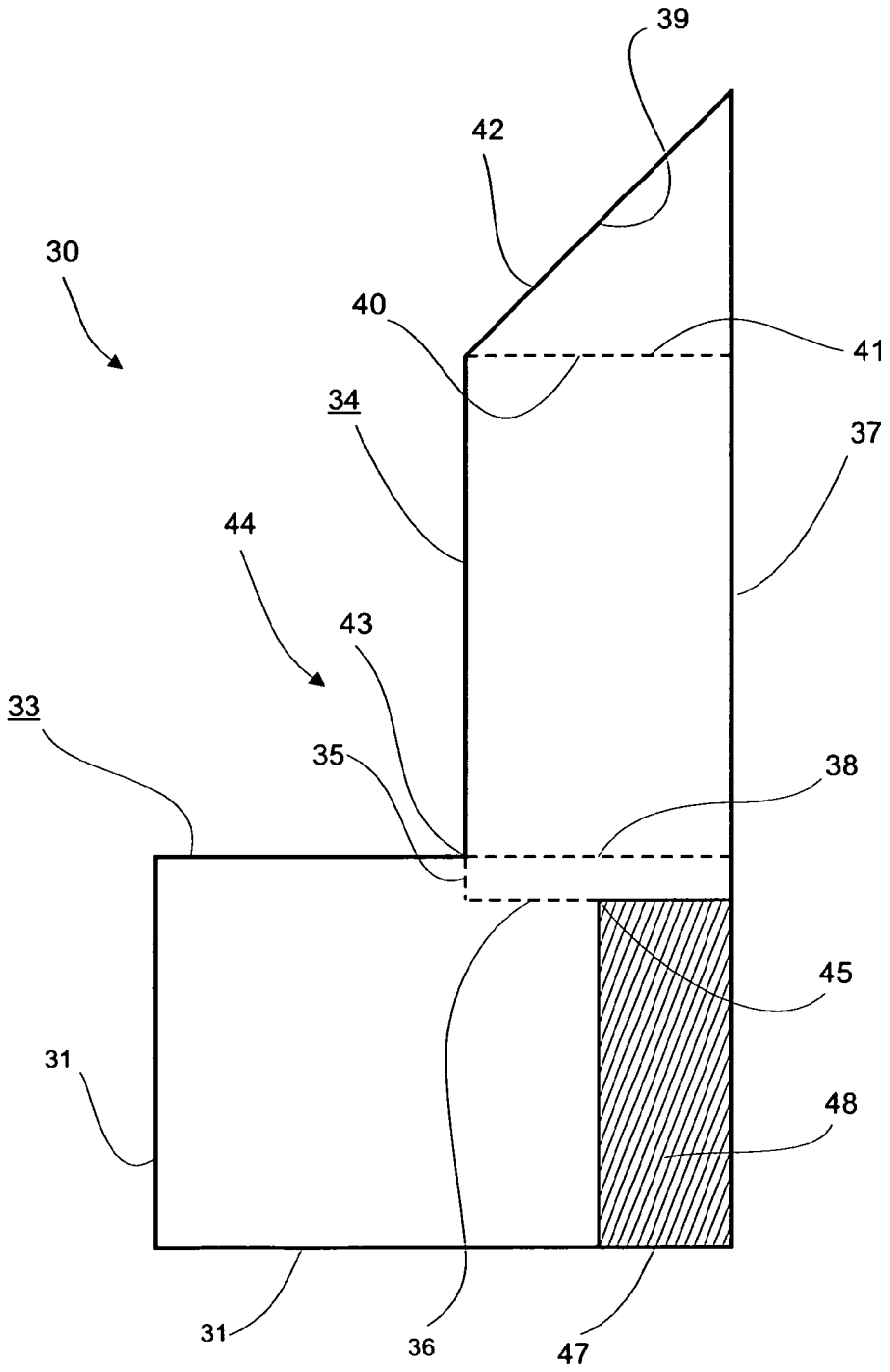
FIG. 1 is a side view of a multi-geometry article for supporting a conga drum, according to one aspect of the disclosure.
Figure 2:
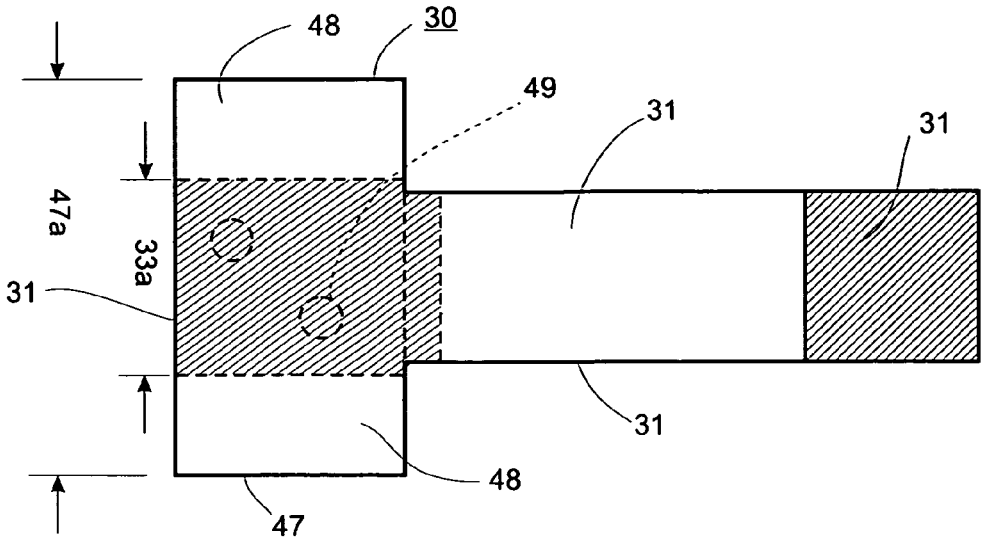
FIG. 2 is a plan view of the article illustrated in FIG. 1.
Figure 3:
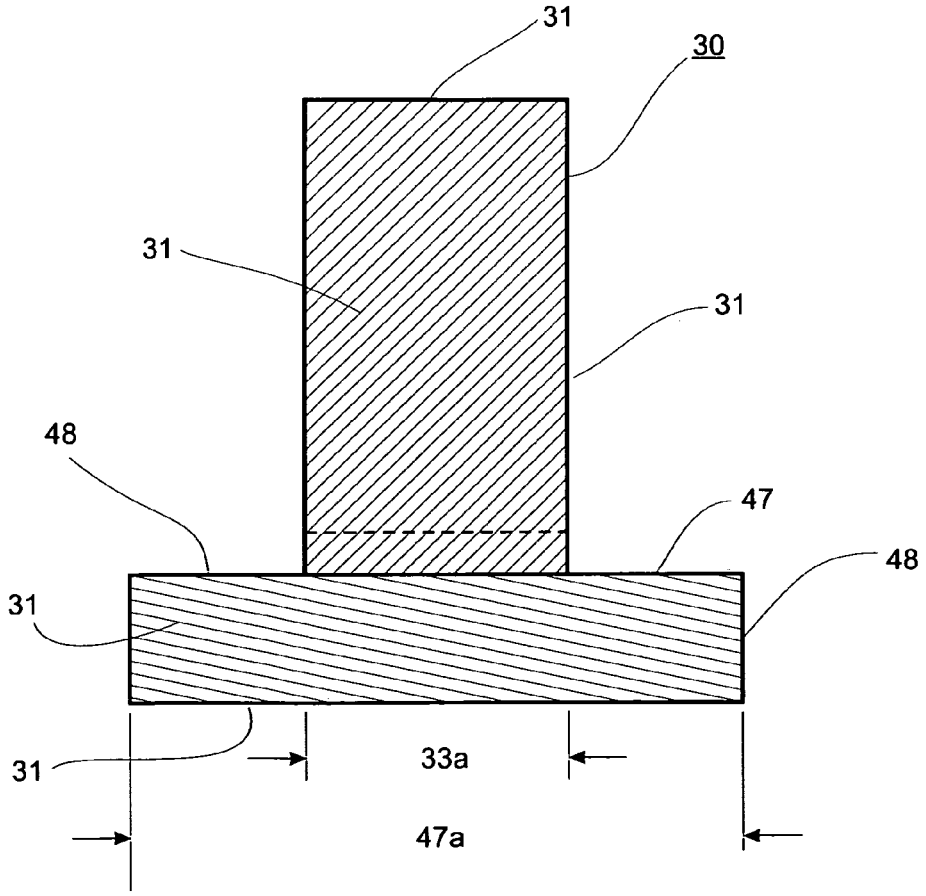
FIG. 3 is a rear view of the article shown in FIG. 1.

As illustrated in FIG. 2, horizontally disposed body 47, for instance, upon engagement with vertically disposed body 33, is mounted thereto using suitable fasteners 49, e.g., threadably, such as by one or more conventional bolt and/or screws, so as to firmly secure the respective bodies to one another. Alternatively or concurrently, the horizontally disposed body is formed with the vertically disposed body as a single or one piece unit, the resulting unit having the aforementioned configuration.

Figure 4:
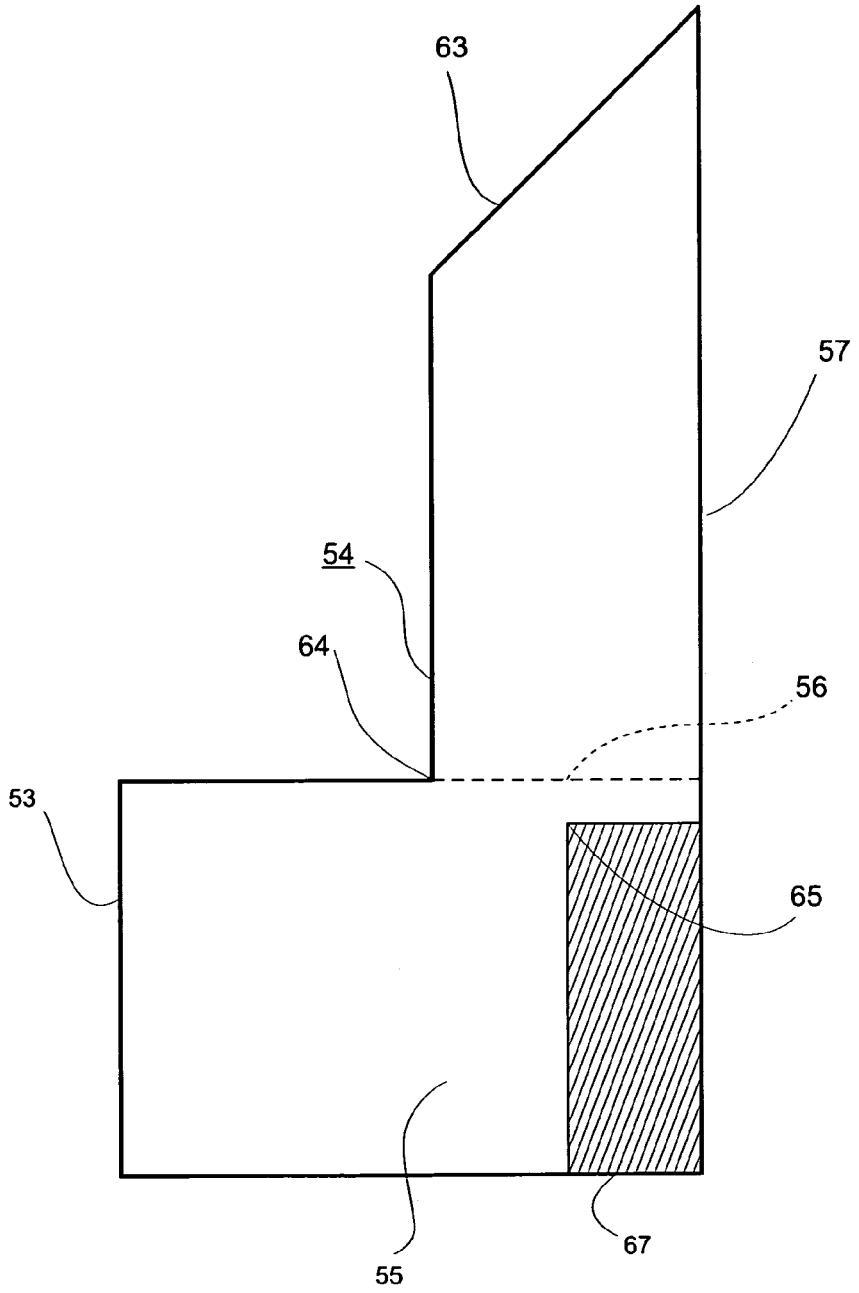
FIG. 4 is a side view of the article, according to another aspect of the disclosure.
Figure 5:
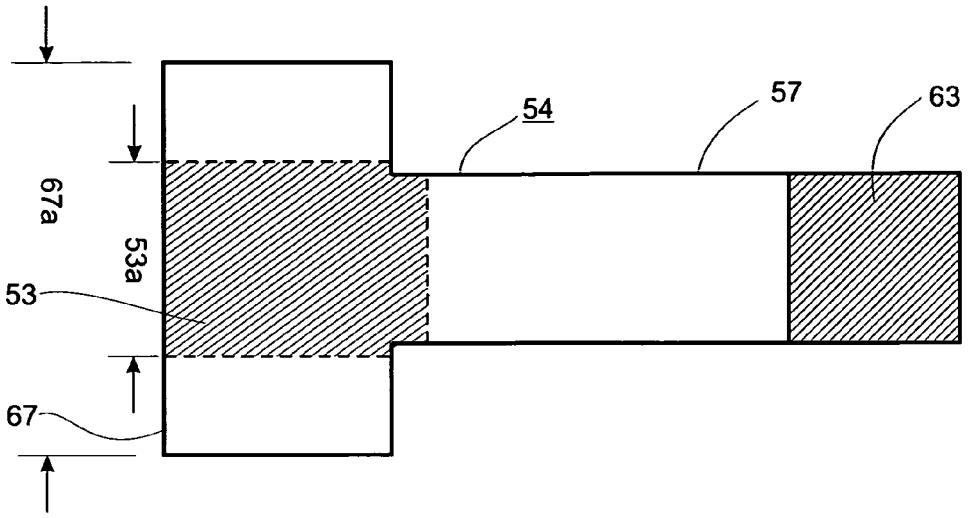
FIG. 5 is a plan view of the article illustrated in FIG. 4.
Figure 6:
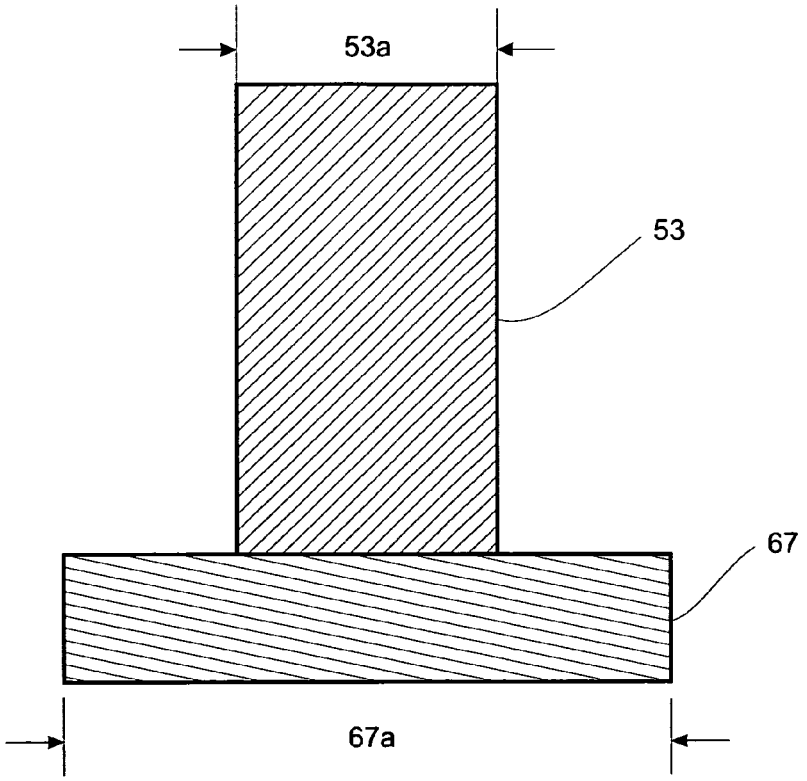
FIG. 6 is a side view of the article set forth in FIG. 4.

According to another embodiment, set forth generally in FIGS. 4-6, each article comprises a first elongated housing 53, disposed in a first direction, the housing having major and minor portions, a stepwise portion 54 being formed with and extending from minor portion 55 from one side 56 of the body, the stepwise portion having an elongated portion 57 formed with and extending radially from the stepwise extension, the elongated portion side generally being in alignment and coextensive with the stepwise extension and having a sloping surface 63 in proximity to an outward end thereof, the elongated housing and the stepwise portion defining first and second rabbet-like or notch joint regions 64, 65, respectively, the first region being configured for receiving lower edge 22 of the conga drum, and a second elongated housing 67 being formed with and extending generally laterally from the second joint region, the width 53*a* of the first elongated housing being substantially less than the length 67*a* of the second elongated housing such that one or more portions 68 of the second elongated body protrude radially therefrom. Alternatively or concurrently, the respective housings, portions and extensions are formed as a single or one piece unit with the aforementioned configuration.

In operation, according to one arrangement, a plurality of multi-geometry articles are formed, each of which comprises a rectangular, vertically disposed block-like body section with a step-like rectangular block extension formed with and extending from a bottom portion of one side face of the body, the rectangular extension having a truncated trapezoidal block extension formed with and extending from a laterally extending face of the rectangular extension. The face of the trapezoidal extension truncated side is preferably in alignment and coextensive with the laterally extending face and the sloping side of the trapezoidal extension faces outwardly therefrom. The rectangular body section and the step-like rectangular block extension defines, at an upper point of intersection, a first rabbet-like or notch joint for receiving a selected lower edge of a conga drum, and defining, at a lower point of intersection, a second rabbet-like or notch joint for receiving a rectangular, horizontally disposed block-like body, the width of the vertically disposed body being substantially less than the length of the horizontally disposed body such that, upon engagement of the horizontally disposed body with the rabbet-like or notch joint of the vertically disposed body, one or more portions of the horizontally disposed body protrude laterally from vertical sides of the vertically disposed body.

While the article has been shown and described as having particular dimensions and proportions which may be desirable for the application disclosed, those skilled in the art will appreciate that the article may take any size, shape, configuration or relative proportion, giving consideration to the purpose for which it is intended.

As illustrated generally in FIGS. 7 and 9, the articles are then arranged radially in a selected plane and in a first orientation relative to and corresponding with a bottom edge of a selected conga drum such that the second rabbet-like or notch joint of each article engages the bottom edge portion of the drum and the respective bottom faces of the horizontally disposed body and of the trapezoidal extension are in engagement with and generally flat against the floor.

Alternatively, a plurality of multi-geometry articles are formed, as above, each of which comprises a first elongated housing, disposed in a first direction, the housing having major and minor portions, a stepwise portion being formed with and extending from the minor portion from one side of the body, the stepwise portion having an elongated portion formed with and extending radially from the stepwise extension. Desirably, the elongated portion side is generally in alignment and coextensive with the stepwise extension and has a sloping surface in proximity to an outward end thereof. The elongated housing and the stepwise portion define a first rabbet-like or notch joint region for receiving a selected lower edge of a conga drum, and define a second rabbet-like or notch joint region, a second elongated housing being formed with and extending generally laterally from the second rabbet-like or notch joint region. The width of the first elongated housing is substantially less than the length of the second elongated housing such that one or more portions of the second elongated body protrude laterally.

Next, as shown again in FIGS. 7 and 9, the articles are arranged radially in a selected plane and in a first orientation relative to and corresponding with a bottom edge of a selected conga drum such that the second rabbet-like or notch joint of each article engages the bottom edge portion of the drum and the respective bottom faces of the horizontally disposed body and of the trapezoidal extension are in engagement with and generally flat against the floor. Alternatively or concurrently, the respective housings, portions and extensions are formed as a single unit with the aforementioned configuration.

These article configurations, when arranged according to this disclosure, are advantageous in their ability to be oriented in a first selected direction, e.g., as a short stand according to FIG. 7, to support a conga drum at one height, e.g., about 6 inches, and orientation relative to the ground, such as a floor, or, in the alternative or concurrently therewith, to be oriented in a second selected direction, e.g., as a tall stand according to FIG. 8, to support a conga drum at a second height, e.g., approximately 8 inches, and orientation relative to the ground. In other words, this block configuration, when arranged suitably, provides support of conga drums at two or more different heights by simply changing the position of the one relatively flat side or end to another, i.e., from one orientation where the trapezoidal extension long side is in engagement with and flat against the ground (see FIGS. 7 and 9) to another orientation where the rear of the vertically disposed body and horizontally disposed body are in engagement with and generally flat against the ground (see FIGS. 1 and 4). In this manner, the drum is raised or lowered relative to the ground rather dramatically without a mechanical process or an elaborate, involved procedure.

Preferably, each article is impact resistant, being constructed, at least in part, of wood and/or a selected polymeric material that is molded or carved to insure it never loses its shape or strength. Other suitable materials include, but are not limited to, a conventional high density but light weight plastic, either transparent or translucent or faux stone in appearance. As an added feature, the articles are manufactured in one or more colors so as to match the drums or to the drummer's personal preference with spray paint modification.

Although the stand has been shown and described as using a selected wood and/or polymeric material or the like construction, those skilled in the art will appreciate that other materials may be used suitably, within the spirit and scope of this disclosure, giving consideration to the purpose for which the stand is intended.

Desirably, when not in use, the articles are placed, for instance, due to their light weight construction, in a conventional soft, drawstring bag or the like, which may be conveniently stored inside a conga drum for transport. Since the articles, when arranged in an array upon use, only come into contact with the drum at the lower rim, which is typically already protected by a metal band, the stand according to this disclosure it will not mar the finish of the drum during use.

Overall, the portable stand provides a simple array of support solutions for a music instrument, in general, and a conga drum, in particular, that operate in tandem or separately to balance and support as many drums as a performer desires. The method of using the stand to support a conga drum is suitable for playing any sized drum and in a preferred position, whether standing, seated or otherwise. The stand is easy to carry but without the inconvenience of requiring a special housing, special tools or extra cases.

It also supports the fierce pounding and strikes of master and novice drummers applying rhythms to the drum heads, without interfering with the tone of the drum or the timbre of the rhythm, and provides a stand that is rock solid and does not make any noise or sounds that would interfere with the tone or rhythm being created. To this end, the stand is not only constructed of materials that meet the standards of extreme handling and very aggressive pressures, but also has no moving parts.

Moreover, a customizable, user selected arrangement is provided for supporting a conga drum, depending on user preference and/or experience level, which especially accommodates play from a seated position. Specifically, the stand is designed so that a typical drummer can use four articles, although those skilled in the art will appreciate that more experienced players may choose to use only three on each drum. In some instances, a drummer may want to use only one stand beneath the drum.

Various modifications and alterations may be appreciated based on a review of this disclosure. These changes and additions are intended to be within the scope and spirit of the disclosure as defined by the following claims.

What is claimed is:

1. A portable music stand comprising a plurality of multi-geometry articles arranged in a selected array about a support surface for mounting a base portion of a music instrument such as a conga drum, wherein:

each article is configured for engagement with a lower rim of the instrument and suspending the same at a selected height and angle for optimal comfort, efficiency and instrument performance;

each article having a selected number of faces, each of which serves a differing support function and/or provides differing points of contact depending upon the support and positioning desired of the conga drum and orientation of the structure needed to accomplish same;

each article comprising a rectangular, vertically disposed block-like body section with a step-like rectangular block extension formed with and extending from a bottom portion of one side face of the body, the rectangular extension having a truncated trapezoidal block extension formed with and extending from a laterally extending face of the rectangular extension, the face of the trapezoidal extension truncated side being in alignment and coextensive with the laterally extending face and the sloping side of the trapezoidal extension facing outwardly therefrom;

the rectangular body section and the step-like rectangular block extension defining, at an upper point of intersection, a first rabbet-like or notch joint for receiving a selected lower edge of a conga drum, and defining, at a lower point of intersection, a second rabbet-like or notch joint for receiving a rectangular, horizontally disposed block-like body, the width of the vertically disposed body being substantially less than the length of the horizontally disposed body such that, upon engagement of the horizontally disposed body with the second rabbet-like or notch joint of the vertically disposed body, one or more portions of the horizontally disposed body protrude laterally from vertical sides of the vertically disposed body.

2. The stand set forth in claim 1, wherein the multi-geometry articles are shaped for engagement with a lower rim of the drum and suspending the same at a relatively lower height and first selected angle for optimal comfort, efficiency and drum performance, and shaped such that, upon positioning the article in an alternative position, and engagement with the lower rim, the drum is suspended at a relatively greater height and second selected angle for optimal comfort, efficiency and drum performance.

3. A portable music stand comprising a plurality of multi-geometry articles arranged in a selected array about a support surface for mounting a base portion of a music instrument such as a conga drum, wherein:

each article comprises a first elongated housing, disposed in a first direction, the housing having major and minor portions, a stepwise portion being formed with and extending from the minor portion from one side of the body, the stepwise portion having an elongated portion formed with and extending radially from the stepwise extension, the elongated portion side generally being in alignment and coextensive with the stepwise extension and having a sloping surface in proximity to an outward end thereof, the elongated housing and the stepwise portion defining a first rabbet-like or notch joint region for receiving a selected lower edge of a conga drum, and defining a second rabbet-like or notch joint region, a second elongated housing being formed with and extending generally laterally from the second rabbet-like or notch joint region, the width of the first elongated housing being substantially less than the length of the second elongated housing such that one or more portions of the second elongated body protrude laterally.

4. The stand set forth in claim 3, wherein the respective housings, portions and extensions are formed as a single unit with the aforementioned configuration.

5. A method of supporting a music instrument such as a conga drum which comprises the steps of:

(i) forming a plurality of multi-geometry articles, each of which comprises a rectangular, vertically disposed block-like body section with a step-like rectangular block extension formed with and extending from a bottom portion of one side face of the body, the rectangular extension having a truncated trapezoidal block extension formed with and extending from a laterally extending face of the rectangular extension, the face of the trapezoidal extension truncated side being in alignment and coextensive with the laterally extending face and the sloping side of the trapezoidal extension facing outwardly therefrom, the rectangular body section and the step-like rectangular block extension defining, at an upper point of intersection, a first rabbet-like or notch joint for receiving a selected lower edge of a conga drum, and defining, at a lower point of intersection, a second rabbet-like or notch joint for receiving a rectangular, horizontally disposed block-like body, the width of the vertically disposed body being substantially less than the length of the horizontally disposed body such that, upon engagement of the horizontally disposed body with the rabbet-like or notch joint of the vertically disposed body, one or more portions of the horizontally disposed body protrude laterally from vertical sides of the vertically disposed body; and (ii) arranging each of the articles radially, in a selected plane and in a first orientation relative to and corresponding with a bottom edge of a selected conga drum such that the second rabbet-like or notch joint of each article engages the bottom edge portion of the drum and the respective bottom faces of the horizontally disposed body and of the trapezoidal extension are in engagement with and generally flat against the floor.

6. The method set forth in claim 5, further comprising the step of forming the respective housings, portions and extensions as a single unit with the aforementioned configuration.

* * * * *